US005531875A

United States Patent [19]

Shimamune et al.

[11] Patent Number: 5,531,875

[45] Date of Patent: Jul. 2, 1996

[54] ELECTRODE SUBSTRATE FOR ELECTROLYSIS AND PRODUCTION METHOD THEREOF

[75] Inventors: Takayuki Shimamune; Yasuo Nakajima, both of Tokyo, Japan

[73] Assignee: Permelec Electrode Co., Ltd., Kanagawa, Japan

[21] Appl. No.: 294,046

[22] Filed: Aug. 24, 1994

[30] Foreign Application Priority Data

Aug. 24, 1993 [JP] Japan ..... 5-230841

[51] Int. Cl.[6] ..... C25B 11/04; C25B 11/10

[52] U.S. Cl. ..... 204/290 R; 204/290 F

[58] Field of Search ..... 204/290 F, 192.15, 204/192.1; 205/102, 103, 224, 227, 206, 212, 257; 427/125, 126.5, 383.7, 405, 437, 327, 328

[56] References Cited

U.S. PATENT DOCUMENTS 4,140,813 2/1979 Hund et al. ..... 427/34

4,395,436 7/1983 Bianchi et al. ..... 427/53.1

5,354,444 10/1994 Shimamune et al. ..... 204/290 F

*Primary Examiner*—Kathryn Gorgos

*Attorney, Agent, or Firm*—Sughrue, Mion, Zinn, Macpeak & Seas

[57] ABSTRACT

There are provided an electrode substrate for electrolysis comprising an electrically conductive metallic base material and a coating layer having a thickness of from 10 to 200 μm composed of a platinum group metal and partial oxides of a non-stoichiometric composition containing at least one kind of metal selected from the group consisting of titanium, tantalum and niobium, and oxygen formed on the surface of the base material and a method of producing the electrode substrate. The electrode substrate has a sufficient durability and a chemical stability under a high electric current density, and can be stably used for a long period of time for use under a cathodic polarization in an electrolysis, etc., with a positive-negative inversion, and the use in an electrolyte containing corrosive materials.

2 Claims, No Drawings

ELECTRODE SUBSTRATE FOR ELECTROLYSIS AND PRODUCTION METHOD THEREOF

FIELD OF THE INVENTION

The present invention relates to an electrode substrate for electrolysis having high durability and a production method thereof. More specifically, the invention relates to an electrode substrate for electrolysis, which can be used at high electric current density and has durability to an oxygen generating reaction, and resistance to reverse electric current.

BACKGROUND OF THE INVENTION

Industrial electrolysis, in particular, electrolysis using an inorganic acid as the main electrolyte, has been practiced widely, such as electric metal refining, electric plating, electrolytic syntheses of organic materials and inorganic materials, etc. As the electrode, in particular an anode for these electrolyses, a lead or a lead alloy electrode, a platinum-plated titanium electrode, a carbon electrode, etc., has been used, but these electrodes have shortcomings and, hence, have not been widely used for electrolysis. For example, in a lead electrode, lead dioxide which is relatively stable and has good electrical conductivity is formed on the surface of the electrode but such a lead electrode has the shortcomings that the lead dioxide dissolves at a rather large wear rate of several mg/AH under ordinary electrolytic conditions and also the over-voltage is large. Also, the platinum-plated titanium electrode has a rather short life for high cost. Furthermore, the carbon electrode has the shortcoming that when the anodic reaction is an oxygen generation reaction, the carbon electrode reacts with generated oxygen to consume the electrode itself by forming carbon dioxide, and also the electric conductivity thereof is inferior.

Thus, to overcome these shortcomings of these electrodes, a dimensionally stable electrode (DSE) has been developed and has been widely used.

The DSE is composed of a valve metal such as titanium as the substrate and when the DSE is used as an anode, the surface of the substrate is passivated and the electrode functions as a very chemically stable long-life electrode. However, when the DSE is used as the cathode and is cathodically polarized, the electrode reacts with hydrogen generated at the cathode to form a hydride, whereby the substrate itself becomes brittle and the surface coating is released by corrosion to greatly shorten the life of the electrode and, in particular, a major shortcoming in using the DSE for electrolysis then occurs wherein positive and negative are inverted, that is, the direction of the electric current is reversed.

To avoid the occurrence of these shortcomings, the use of nickel or stainless steel having a durability against the cathodic polarization has been taken into consideration as the substrate material, but since such a material cannot be used as an anode in neutral to acidic solutions, it is clear that the material is unsuitable as an electrode for electrolysis wherein both positive and negative polarizations are given. Also, carbon electrode such as graphite, etc., which is said to be durable to both anodic polarization and cathodic polarization, has a tendency for the surface layer to fall off with generation of gas, and the tendency is particularly large in the electrolysis where both positive and negative polarization occur, whereby the foregoing material may be theoretically usable but the practical usable value is less.

For overcoming the problems in the conventional techniques described above and, in particular, for preventing the occurrence of the passivation of the interlayer, a method of forming the interlayer by flame spraying of tantalum wire onto the substrate is proposed as described in JP-A-5-156480 (the term "JP-A" as used herein means an "unexamined published Japanese patent application"). It is reported that in flame spraying of tantalum, an interlayer composed of partial oxide of a mixture of metallic tantalum and tantalum oxide was formed. However; tantalum has the shortcoming that it is easily oxidized; that is, tantalum is more liable to be passivated as compared with other metals; in particular, a long life cannot be expected in the case of using tantalum under severe conditions, and further the use thereof is limited owing to the high cost.

As described above, in the valve metals, iron family metals, and the alloys thereof, materials stable to both the cathodic and anodic polarizations do not exist. However, in ceramics, which are one kind of metal oxides, there exist materials which are stable to both the cathodic and anodic polarizations and give an electric conductivity to a certain extent. However, the electric conductivity of ceramics is far lower than that of metals and further in this kind of electrode being industrially used, a polycrystalline sintered material must be used, whereby such a material has a large electric resistance and is unsuitable as an electrode.

SUMMARY OF THE INVENTION

The object of the present invention is to solve the problems described above with conventional electrode substrates, in particular, a substrate such as the DSE, etc., and to provide an electrode substrate for electrolysis, which has a sufficient durability and a chemical stability under a high electric current density, and which can be stably used for a long period of time for the use under a cathodic polarization in an electrolysis, etc., with a positive-negative inversion and the use in an electrolyte containing corrosive materials, and also to provide a method of producing the electrode substrate.

That is, according to one aspect of the present invention, there is provided an electrode substrate for electrolysis comprising an electrically conductive metallic base material and a coating layer having a thickness of from 10 to 200 μm composed of 1) a platinum group metal and 2) a partial oxide of a non-stoichiometric composition containing i) at least one kind of metal selected from the group consisting of titanium, tantalum and niobium, and ii) oxygen formed on the surface of the base material.

In the electrode substrate of the present invention described above, a bonding layer composed of a metal oxide may be formed between the base material and the coating layer.

According to another aspect of the present invention, there is provided a method of producing an electrode substrate for electrolysis as described herein below.

DETAILED DESCRIPTION OF THE INVENTION

The features of the present invention concern providing an electrode substrate for electrolysis which has sufficient durability and chemical stability under high electric current density, and can be stably used for a long period of time for use under cathodic polarization in electrolysis, etc., accompanied by a positive-negative inversion and for use in electrolyte containing corrosive materials, which have never been realized in conventional techniques. A coating layer composed of a platinum group metal and a partial oxide of a non-stoichiometric composition is formed on an electrically conductive metallic base material to utilize the electrical conductivity and the corrosion resistance of the oxide, and also to utilize the resistance to electrolysis, wherein a positive-negative inversion occurs, and relatively large electric conductivity of the forgoing platinum group metal.

There is no particular restriction on the electrically conductive metallic base material to be used in the present invention as long as the base material is electrically conductive, since the base material is isolated by the coating layer formed on the surface thereof. But there is the possibility of sometimes forming pinholes, and hence, in the case of using the electrically conductive metallic base material as an anode, for example, in a strong acid, it is desirable to use a valve metal such as titanium, etc., or an alloy thereof having a relatively high corrosion resistance and, in particular to use titanium or a titanium alloy having good workability and being relatively inexpensive. As a matter of course, in other electrolysis, an iron group metal such as nickel, etc., and a corrosive alloy such as stainless steel or HASTELLOY (trade name, made by Hayness Stekkute Co.), etc., can be used.

In the present invention, it is desirable to apply a roughening treatment to the surface of the base material prior to the formation of the coating layer on the base material. Since the foregoing coating layer has a thickness of from 10 to 200 μm which is rather thick as a surface layer, the foregoing roughening treatment is applied to give an anchor effect for firm adhesion of the coating layer and give stronger chemical bonding between the foregoing base material and the coating layer, etc.

As the typical roughening method, there are a physical method and a chemical method. The roughening is carried out with care so that impurities do not remain on the surface of the base material and so that a chemically unstable processed layer is not remain after roughening. There is no particular restriction on the extent of roughening, but it is desirable that in the roughening extent, JIS $R_a$=about 10 to 20 μm and JIS $R_{max}$=about 50 to 200 μm.

For the physical roughening method described above, there is, for example, roughening with blasting whereby the surface of the base material is ground with ceramic sands such as alumina, etc., to form an uneven surface. In the case of employing the blasting method, considering the possibility of an electrolyte penetrating to the surface of the base material of the electrode formed, use of alumina or silica being inert to an acid and an alkali as the blasting media is preferred. That is, when alumina, etc., is used as the blasting media, even when the media remains on the surface of the base material, the electrode can be stably used without causing an unusual dissolution. As a matter of course, it is more preferred to apply a pickling treatment, etc., to prevent these medias trapped on the surface of the base material from remaining therein.

In regard to the chemical roughening method described above, roughening of the surface of the base material is carried out with chemicals. For example, in the case of using titanium or titanium alloy as the base material, by immersing the previously cleaned base material into an aqueous solution of about 20% hydrochloric acid at the temperature of from about 85° to 90° C. and keeping the base material in the solution for a few hours, the surface causes an intergranular corrosion to perform roughening. Also, when the base material is titanium or stainless steel, by immersing the base material in an aqueous solution of about 10% iodic acid at a temperature of from about 40° to 60° C., the base material causes a so-called pitting corrosion to roughen the surface of the base material.

The coating layer containing platinum group metals and their partial oxides may be directly formed on the surface of the base material, but, in particular, when the metal constituting the foregoing base material differs from the metal constituting the coating layer, there is the possibility that adhesion of the coating layer to the base material becomes inferior and the possibility is further increased in the case of using flame spraying for forming the coating layer. In this case, it is preferred to form a bonding layer composed of metal oxides between the base material and the coating layer. The thickness of the binding layer is preferably from 0.1 to 1 μm. In forming the bonding layer, it is preferred that the bonding layer is composed of a mixture of the oxide of the base material metal (metal forming the base material) and the oxide of the metal forming the coating layer. The bonding layer must be electrically conductive and is preferably composed of semiconductive oxides formed by coating a solution of the salts of the metals constituting the base material and the coating layer, respectively, on the base material and thermally decomposing the metal salts at a temperature of from 300° to 600° C. Also, it is possible to make semiconductive oxides by forming non-conductive oxides on the base material and thereafter applying a plasma flame onto the surface thereof to partially remove oxygen from the oxides.

Then, on the roughened surface of the base material as described above or on the surface of the bonding layer formed on the base material, there is formed a coating layer containing a platinum group metal such as platinum, rhodium, ruthenium, iridium, etc., and metal oxide(s) having the similar property as the ceramics described above. The metal oxides are composed of non-stoichiometric partial oxides containing at least one kind of a metal selected from the group consisting of titanium, tantalum, and niobium and oxide(s) of the metal(s). It is necessary that the coating layer has an electrical conductivity and substantially completely covers the electrically conductive base material or the bonding layer formed thereon. There is no particular restriction on the forming procedures of the partial oxide(s) in the coating layer if the partial oxide(s) formed are a non-stoichiometric composition, that is, are shown by the composition formula $RO_{2-x}$ (wherein R represents a metallic component and $0<x<1$).

The oxide comprising at least one kind of titanium, tantalum and niobium, which is present in the coating layer, is a ceramic itself and is stable to electrolysis containing fluorine components and organic materials intermixed in the electrolyte. However, although the coating layer is far more stable than the metallic base material in the electrolysis wherein the positive-negative inversion occurs, in particular, in cathodic polarization, the prevention of penetration of very small hydrogen ions through the coating layer becomes incomplete and there is the possibility that hydrogen ions may reach the base material through a liquid and a solid, whereby the base material metal is broken by cathodic polarization. To avoid this occurrence, the platinum group metal is added into the coating layer in the present invention, whereby an electrode which can endure the electric current inversion can be provided.

The reason for this is unknown but it is believed that the coating layer containing the platinum group metal inhibits the transfer of oxygen ions formed in the case of using the base material as an anode, and also similarly inhibits the transfer of hydrogen ions formed in the case of using the base material as a cathode. It is unnecessary that the platinum group metal exists in a large amount, and a sufficient amount thereof is 5 g/m$^2$ or less in terms of metal, but it is preferred that the metal is uniformly dispersed throughout the whole surface. The preferred lower limit of the amount of the platinum group metal is about 0.5 g/m$^2$ in terms of metal. The most preferred amount thereof is from 1 to 2 g/m$^2$ from the practical point of view.

The coating layer containing the platinum group metal and the partial oxide may be formed by any desired method but it is desirable to form the coating layer by a flame spraying method such as a plasma spraying method, an arc spraying method, etc. When the coating layer containing the platinum group metal and the metal oxide is formed on the metallic base material by flame spraying, the coating layer formed becomes a precise layer having a substantially large surface area by the property of arc spraying or plasma spraying itself, and substantial electric current density can be lowered in the case of using for electrolysis. Furthermore, a good electric conductivity by the metal and a strong adhesion between the flame sprayed coating layer and the base material metal can be attained. Also, an electrode substrate for electrolysis having a good resistance caused by the formation of electrically conductive oxides by the oxygen deficiency of the partial oxide caused by the metal existing in large quantities is obtained, and further the progress of passivation is restrained by the oxidation resistance of titanium, etc., under ordinary electrolytic conditions, whereby the electrode substrate can be used for a long period of time.

The particle sizes of the flame spraying particles may be selected according to the purpose desired, but since the desired final substance is an electrode substrate, the substantial surface area of the flame spraying particles is desired to be as large as possible. It is desirable that the surface roughness of the electrode substrate is about JIS $R_{max} \geqq 100$ μm and JIS $R_a \geqq 10$ μm, and for attaining the surface roughness, it is preferred to use flame spraying particles having particle sizes of from 20 to 100 μm and also metal wire can be used for flame spraying.

If the particle sizes of the flame spraying particles are smaller than 20 μm, a compact coating layer can be expected but the surface roughness becomes small and there is the possibility of excessively proceeding the oxidation at flame spraying. On the other hand, if the particle sizes are over 100 μm, the formation of precise coating layer without having open pore becomes difficult.

Also, when the flame spraying material is a metal only, the coating layer can be formed by an arc spraying method using metal wire as the raw material. In this case, the compactness is about 5 to 10% inferior to the case of plasma spraying, but since there is a feature that the roughness of the surface becomes larger, the roughness can be selected according to the desired. In addition, as titanium oxide, tantalum oxide, and niobium oxide that is used for flame spraying, purified rutile, tantalite, and columbite can be used in situ, respectively.

The thickness of the coating layer formed is suitably from 10 to 200 μm. If the thickness of the coating layer is thinner than 10 μm, there is an increased possibility of leaving open pores, and if the thickness is thicker than 200 μm, the coating layer becomes too heavy and too ductile, whereby the coating layer is liable to be released, and the electric conductivity of the coating layer is from $10^{-2}$ to $10^{-3}$ Ωcm, and the ohm loss becomes large under high electric current density which creates a strong tendency of shortening the electrode life by local heating.

In regard to incorporating the platinum group metal in the coating layer by a flame spraying method, a thin layer of the platinum group metal may be previously formed on the surfaces of the flame spraying particles of metallic titanium, titanium oxide, etc. That is, after activating the surfaces of the metal and/or oxide particles being flame sprayed with a volatile acid such as hydrochloric acid, etc., the particles are immersed in an aqueous solution or an alcohol solution of a salt of the platinum group metal, such as a chloroplatinate, etc., to form a thin layer of the salt of the platinum group metal on the surfaces of the particles. After drying the particles, the particles are heat-treated at a temperature of from about 400° to 800° C. to thermally decompose the foregoing metal salt, whereby the platinum group metal is deposited on the surfaces of the particles, and then the particles are flame sprayed onto the surface of the base material, whereby the coating layer composed of the partial oxide having been dispersed therein the platinum group metal can be formed on the base material.

In this case, since, to the platinum group metal compound (salt) existing on the surfaces of the particles before flame spraying, heat is added by flame spraying, it is not always necessary to previously reduce the compound into the platinum group metal by thermally decomposing the compound before flame spraying. But when the platinum group metal is deposited by previously thermally decomposing the compound, the yield of the platinum group metal is improved.

In addition, it is not always necessary to carry the platinum group metal on the surfaces of the whole flame spraying particles and the coating layer can be formed by flame spraying mixed particles composed of the particles carrying the platinum group metal or the compound thereof and the particles without carrying such a metal or the compound.

Also, the coating layer without containing the platinum group metal is formed by flame spraying, etc. Thereafter, the platinum group metal is applied onto the surface of the coating layer by a vapor deposition or a thermal decomposition method, to uniformly disperse the metal in the coating layer, whereby the coating layer containing the platinum group metal and the partial oxide may be formed.

For forming the foregoing non-stoichiometric partial oxide, a flame spraying method is most suitable. When a flame sprayed material is formed by ordinary plasma spraying, the flame sprayed material itself is in a strong reducing atmosphere, an oxide is not formed in the atmosphere, but upon actual formation of the coating, a metal flame spray tends to be converted into the oxide in a cooling step and an oxide surface is sometimes formed. Hitherto, for preventing the formation of the oxide, the occurrence of the oxidation is restrained by using an inert gas such as nitrogen, argon, etc., as the sealing gas. However, in the present invention aiming at the formation of the non-stoichiometric partial oxide, the phenomenon of forming the oxide is rather positively utilized, and by only flame spraying metal particles, part of the flame sprayed metal is converted into the metal oxide to proceed the formation of the non-stoichiometric composition, whereby the formation of the coating layer containing an electrically conductive oxide is intended.

In regard to the method of forming the non-stoichiometric partial oxide by a flame spraying method, there are the following additional two methods: that is, a method of forming the oxide by using an oxidative sealing gas and a method of forming the oxide by using flame spraying oxide particles.

That is, flame spraying metal particles or wire is sprayed onto the roughened surface of the base material using a mixed gas of argon and helium as the plasma gas according to an ordinary flame spraying condition. In this case, when an oxidative gas is used as the surrounding sealing gas, part of the flame sprayed metal is oxidized to form a mixed coating layer composed of partial oxide containing the flame sprayed metal and the metal oxide thus formed. The amount of the oxide formed differs according to the conditions. For example, when air is used as the oxidative gas, and the particle size of the titanium particles as the spraying metal is from 30 to 60 μm, 20 to 30% of the flame sprayed titanium metal is converted into titanium oxide and a mixed coating layer of the partial oxide containing from 70 to 80% flame sprayed titanium and from 30 to 20% titanium oxide is formed. When the content of oxygen in the oxidative gas is increased about 50%, the amount of the oxide is increased to about 50%. However, if the amount of the metal oxide is further increased, an insulating oxide is formed which creates the possibility of losing the electrical conductivity and which also creates the possibility that the oxidation proceeds explosively.

Also, when a mixture of the metal particles or wire and the metal oxide is used as the flame spraying material in place of the metal particles or wire only, and when the mixture is sprayed under the similar flame spraying condition, a mixed coating layer of the partial oxide containing the metal and the metal oxide at a desired ratio is formed.

In addition, it is sometimes desirable that the coating layer contains all the metals of titanium, tantalum, and niobium and oxides of these metals. In this case, in the method of using the oxide powder as part of the particle powder, ratio of the metals to each other and the ratio of the flame sprayed metals and the flame sprayed oxide can be selected to a desired value, which is very convenient, and wide use can be attained to the present invention.

An electrode is prepared by forming a coating of an electrode material containing, for example, iridium oxide on an electrode substrate of the present invention having the structure described above. When an electrode thus formed is used for various kinds of electrolyses, in particular, to an electrolysis wherein reversal current of positive and negative polarization is expected, since the electrode substrate has a far larger durability than those of conventional electrode substrates, in particular, ability for preventing the permeation of an oxygen ion and a hydrogen ion is very big, the occurrence of passivation is delayed, whereby the substantial electrode service life is greatly prolonged.

Examples of the production of the electrode substrate of the present invention are described below, but the examples do not limit the present invention in any way. Unless otherwise indicated all parts percents, ratios and the like are by weight.

EXAMPLE 1

Purified natural rutile was mixed with purified tantalite such that the weight ratio of titanium and tantalum became 9:1 and the mixture was ground in a ball mill. After grinding the mixture for 12 hours, the ground mixture was classified to select the particles having particle sizes of from 20 to 50 μm. After dispersing the mixed particles in 20% boiling hydrochloric acid and keeping them for 30 minutes, the mixed particles were washed with city water to remove iron components. By this operation, the particle sizes of part of the particles became below 20 μm and these particles were removed by a wet classification.

The remaining particles were dried, 30% of the particles were immersed in chloroplatinic acid solution; thereafter, the particles were taken out, and heated in a furnace isolated from air at 550° C. for one hour to provide particles carrying metallic platinum on their surfaces. The coated amount of platinum was 2 g/100 g-particles.

Then, 30% of the particles carrying platinum were sufficiently mixed with the rest 70% particles not carrying platinum to provide a plasma spraying powder.

On the other hand, a commercially available JIS second grade pure titanium plate of 100 mm in length, 100 mm in width, and 3 mm in thickness was used as a base material, and after sand blast-treating with alumina sands having a diameter of 1.2 mm to destroy the surface texture, the surface thereof was washed and degreased with acetone.

The plasma flame spraying powder described above was flame sprayed onto the surface of the titanium plate as the base material using an argon gas containing 10 mol % helium as the plasma gas to form a coating layer having a thickness of about 100 μm and to provide a sample substrate. The coated amount of platinum calculated was 3 g/m$^2$. The surface roughness of the sample substrate obtained was $R_{max}$=200 μm.

On the surface of the sample substrate, there was formed a coating of an electrode material composed of a mixture of iridium oxide and tantalum oxide at 2:1 (mol ratio) by a thermal decomposition method to provide a sample electrode. The coated amounts were 7 g/m$^2$ for iridium and 3 g/m$^2$ for tantalum.

Then, two pieces of the thus produced electrodes were immersed in an aqueous sulfuric acid solution containing 250 g/liter of sodium sulfate and having an adjusted pH of from 0.5 to 1, and electrolysis was carried out by passing an electric current through the electrodes at a temperature of 60° C. with positive-negative inverting every 2 minutes. The electric current density was 300 A/dm$^2$, and even after 1,200 hours, the electrolysis could be further continued.

COMPARISON EXAMPLE 1

By following the same procedure as Example 1 except that platinum was not coated on all the particles, a sample electrode was prepared, and when electrolysis was carried out using the sample electrode under the same condition as in Example 1, after 700 hours of electrolysis, passing of an electric current became impossible.

EXAMPLE 2

By following the same procedure as in Example 1 except for using columbite in place of tantalite, a powder (before carrying platinum) composed of titanium, niobium, and tantalum of 16:3:1 (mol ratio) was prepared. After picking the powder and removing iron therefrom, sponge titanium having an adjusted particle size was added to the powder in an amount of 10% to the amount of titanium of the powder followed by sufficient mixing. The particles were immersed in an isopropyl alcohol solution of chloroplatinic acid and thereafter dried in air at 100° C. to provide a flame spraying powder. The carried amount of platinum was 5 g/kg-particles.

On the other hand, after subjecting the pure titanium plate as used in Example 1 to sand blasting treatment as in Example 1, the surface of the titanium plate was activated by treating it in 20% boiling hydrochloric acid to provide a base material. On the surface of the base material, there was coated an aqueous 5% hydrochloric acid solution of titanium tetrachloride and tantalum pentachloride such that the ratio of titanium to tantalum became 9:1 (mol ratio) followed by baking at 540° C. for 15 minutes in air stream and the operation was repeated 4 times to form a bonding layer composed of a rutile type oxide on the surface of the base material.

The flame spraying powder described above was plasma sprayed onto the surface of the bonding layer to form a coating layer having a thickness of about 100 μm to provide a sample substrate. The coated amount of platinum calculated from the yield was about 3 g/m$^2$ and the surface roughness of the sample substrate obtained was $R_{max}$ about 220 μm.

After coating the electrode material as in Example 1 on the sample substrate by the same manner as in Example 1, the electrolysis was carried out under the same electrolytic condition as in Example 1. Even after 1,200 hours after the intimation of the electrolysis, the electrolysis could further been continued.

EXAMPLE 3

By following the same procedure as in Example 1 except that the flame spraying powder was prepared without a platinum coating and the flame spraying powder was plasma flame sprayed onto the base material as in Example 1 to form a coating layer that did not contain platinum. Then, platinum was coated onto the surface of the coating layer by a physical vapor deposition method such that the carried amount of platinum became 3 g/m$^2$ followed by holding for 3 hours at 600° C. to sufficiently diffuse platinum in the coating layer. Then, the electrode material was coated on the surface by the same manner as in Example 1 to provide a sample electrode.

When an electrolysis with reversal current of positive-negative polarization was carried out with this sample electrode under the same electrolysis condition as in Example 1, the electrode service life of 1,300 hours was obtained.

The electrode substrate for electrolysis of the present invention is composed of an electrically conductive metallic base material and a coating layer having a thickness of from 10 to 200 μm composed of partial oxide of a non-stoichiometric composition containing a platinum group metal, at least one kind of the metal selected from the group consisting of titanium, tantalum, and niobium, and oxygen.

In the electrode substrate of the present invention, the partial oxide only in the coating layer has durability to high electric current and durability to fluorine components, etc., but durability of the coating layer at positive-negative inversion electrolysis is insufficient. However, the platinum group metal existing together with the partial oxide in the coating layer has durability to reversal current with positive-negative polarization electrolysis. Thus, the coating layer has durability against high electric current and fluorine components, etc., and also has resistance at the reversal current with positive-negative polarization change. The electrode substrate of the present invention is almost completely protected by the coating layer to greatly prolong the substantial electrode life.

Also, when the adhesion between the metallic base material and the coating layer is likely to become insufficient, the adhesion can be improved by forming a bonding layer composed of metal oxides containing the metal constituting the base material and the metal constituting the coating layer between both the element, that is, on the surface of the base material.

For producing the electrode substrate for electrolysis of the present invention by forming the coating layer containing the platinum group metal and the partial oxide on the base material, a layer containing the partial oxide only is formed on the base material, and thereafter, the platinum group metal is applied onto the layer by a vapor deposition or a thermal decomposition method to form the coating layer, or, as in the case of a flame spraying method, a metal or a metal oxide carrying thereon the platinum group metal is previously prepared, and the metal or the metal oxide is applied on the base material to form the coating layer.

While the invention has been described in detail with reference to specific embodiments, it will be apparent to one skilled in the art that various changes and modifications can be made to the invention without departing from its spirit and scope.

What is claimed is:

1. An electrode substrate for electrolysis comprising an electrically conductive metallic base material having formed thereon a coating layer having a thickness of from 10 to 200 μm which is composed of 1) a platinum group metal and 2) a partial oxide of a non-stoichiometrical composition containing i) at least one kind of metal selected from the group consisting of titanium, tantalum and niobium, and ii) oxygen.

2. An electrode substrate for electrolysis comprising an electrically conductive metallic base material, a bonding layer composed of metal oxides formed on the surface of the base material, and a coating layer having a thickness of from 10 to 200 μm composed of a platinum group metal and a partial oxide of a non-stoichiometric composition containing at least one kind of metal selected from the group consisting of titanium, tantalum and niobium, and oxygen formed on the surface of the bonding layer.

* * * * *